United States Patent [19]

Croyle

[11] 4,047,648

[45] Sept. 13, 1977

[54] SPOUT WITH SNAP ACTING COVER AND DRAIN HOLE

[75] Inventor: Jack V. Croyle, Woonsocket, R.I.

[73] Assignee: Dart Industries Inc., Los Angeles, Calif.

[21] Appl. No.: 684,342

[22] Filed: May 7, 1976

[51] Int. Cl.[2] ..... B65D 25/42

[52] U.S. Cl. ..... 222/498; 220/375; 222/111; 222/543

[58] Field of Search ..... 222/109, 111, 543, 567, 222/569, 570, 571, 519, 498; 220/375

[56] References Cited

U.S. PATENT DOCUMENTS

| | | | |
|---|---|---|---|
| 1,888,330 | 11/1932 | Robinson | 222/111 |
| 2,601,039 | 6/1952 | Livingstone | 222/570 X |
| 2,763,403 | 9/1956 | Livingstone | 222/111 |
| 2,842,167 | 7/1958 | Tupper | 222/567 X |
| 2,856,104 | 10/1958 | Spiess, Jr. et al. | 222/570 X |
| 2,950,847 | 8/1960 | Tupper | 222/556 X |
| 3,297,208 | 1/1967 | Swett | 222/543 X |

*Primary Examiner*—Robert B. Reeves
*Assistant Examiner*—David A. Scherbel
*Attorney, Agent, or Firm*—Leigh B. Taylor

[57] ABSTRACT

A container for dispensing pourable materials, ideally liquids, having a cup-shaped lower portion with a bottom wall and a continuous upstanding peripheral wall terminating at an upper edge, a seal engaging the upper edge in a liquid type manner, a pouring spout extending upwardly from the seal, an upstanding wall integral with the seal and surrounding the pouring spout, a small opening in the bottom of the wall which permits any liquid collected within the area inside the wall to drain through the hole and into the cup-shaped portion, and a pivotally mounted cap movable from an open position (to permit liquid to be dispensed from the pouring spout) to a position over the pouring spout to seal the pouring spout and the wall opening from the atmosphere. The cap is maintained in the open position by a portion of the pivoting mechanism engaging the top of the seal in a cam-like action.

1 Claim, 11 Drawing Figures

SPOUT WITH SNAP ACTING COVER AND DRAIN HOLE

BACKGROUND OF THE INVENTION

1. Field of the Invention

The present invention relates to a liquid dispensing container, particularly designed for dispensing shoyu sauce.

2. Description of the Prior Art

Generally, the prior art shows dispensing containers of various types and configurations, some of which have dispensing spouts.

The advantage of the present invention is that it is specifically designed for dispensing non-viscous liquids such as shoyu sauce. Its specific features include a pouring lip which minimizes a drippage of the liquid being dispensed and a wall surrounding the pouring spout which has an opening permitting any liquid which inadvertently runs down the pouring spout to be drained back into the container. In addition, a pivotly mounted sealing cap is positionable over the pouring spout and drain opening to seal the contents of the container from the atmosphere.

The container of the present invention permits a user to purchase large bulk quantities of liquid material at a more economical price per unit, and to use the present container for handling smaller quantities.

DESCRIPTION OF THE PREFERRED EMBODIMENT

The container of the present invention includes a cup-shaped portion having a bottom wall 5 and continuous upstanding peripheral wall 6 terminating in a top edge 7. The walls 6 slant slightly outward.

Figure 4:
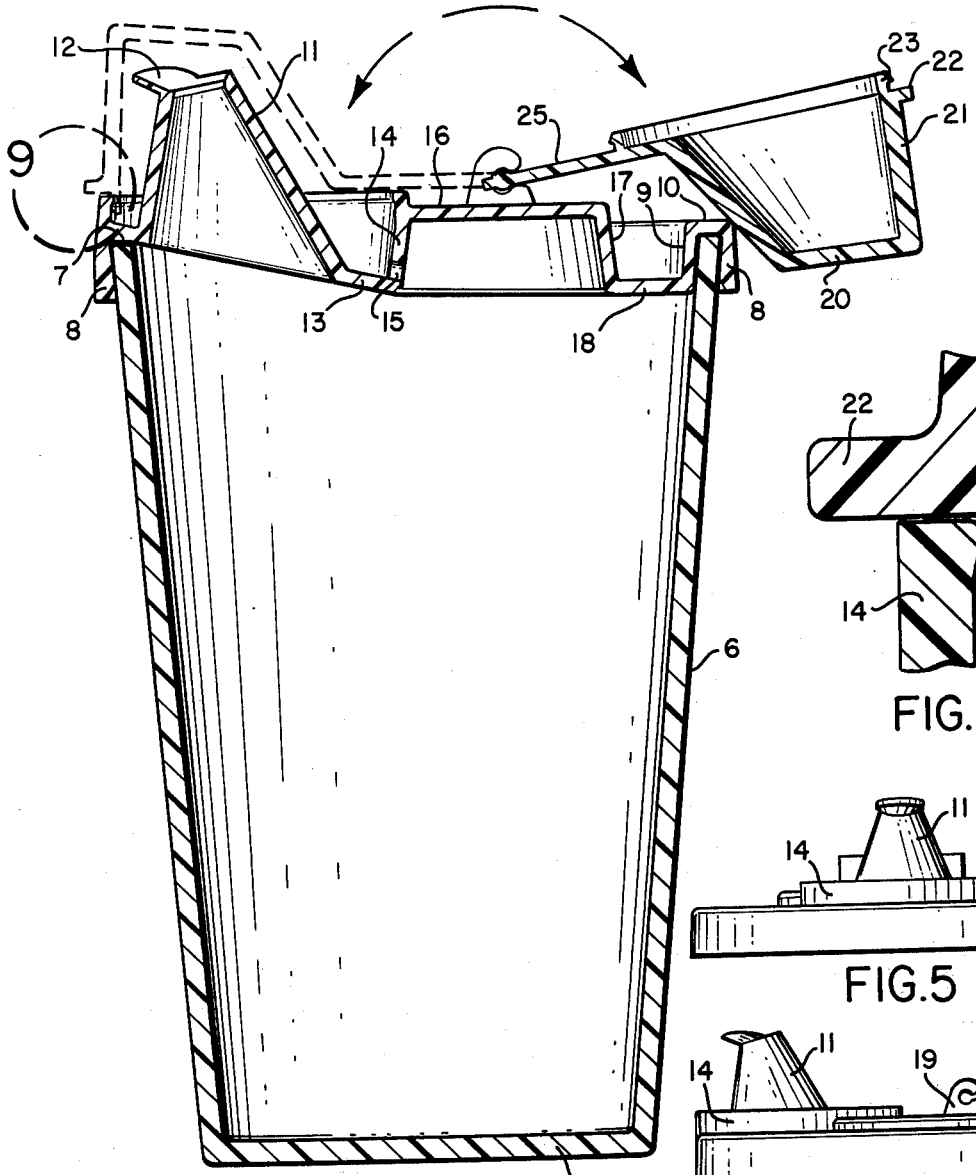
FIG. 4 is a cross-sectional view of the container of the present invention, with the cap in open position.

A seal is placed on the cup portion and engages the upper edge 7 and the side walls 6 to form a liquid-tight connection therebetween. The seal has a peripheral inverted U-shaped groove extending around all of its periphery except the area of the pouring spout which has a construction to be explained hereinafter. The peripheral seal in the pouring spout area is shown in FIG. 4 and consists of an outer wall 8. The U-shaped groove comprises an outer wall 8, an inner wall 9, and a connecting wall 10.

A frustum pouring spout 11 is integral with and extends upwardly from the seal. The pouring spout has a pouring lip 12 affixed to its upper end at an angle of about 25° from the horizontal. The pouring spout 11 has a connecting wall 13 affixed to its lower end and extending outwardly therefrom. An upwardly extending wall 14 is affixed to the outer periphery of connecting wall 13 and completely surrounds the pouring spout. The connecting wall 13 slopes inwardly and downwardly. (See FIG. 4). The lower edge of the innermost part of wall 14 has an opening 15. Any drippage or spillage from the pouring spout 11 will flow down to the connecting wall 13 and eventually flow back into the container through the opening 15. The upper end of wall 14 is connected to an elevated wall 16 which in turn is connected to a wall 17 which extends downwardly to a wall 18 which in turn is connected to wall 9 of the U-shaped peripheral rim.

Figure 1:
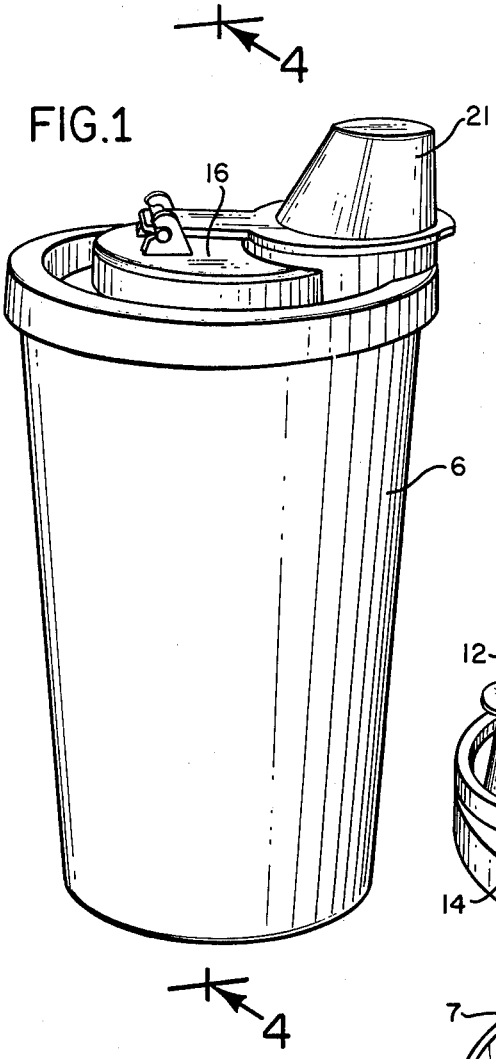
FIG. 1 is a perspective view of the container of the present invention with the container cap in closed position.
Figure 2:
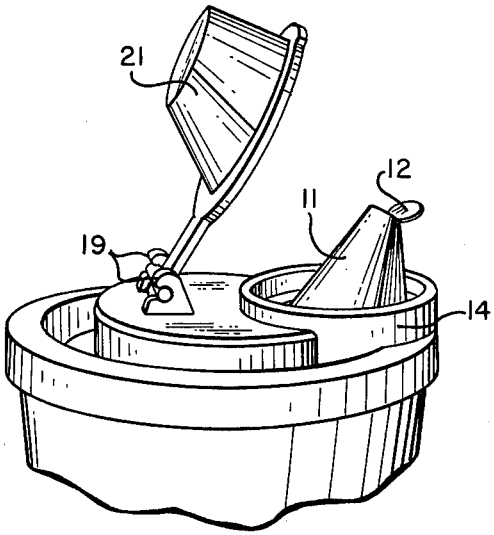
FIG. 2. is a perspective view of the top of the container of the present invention with the cap in open position.
Figure 3:
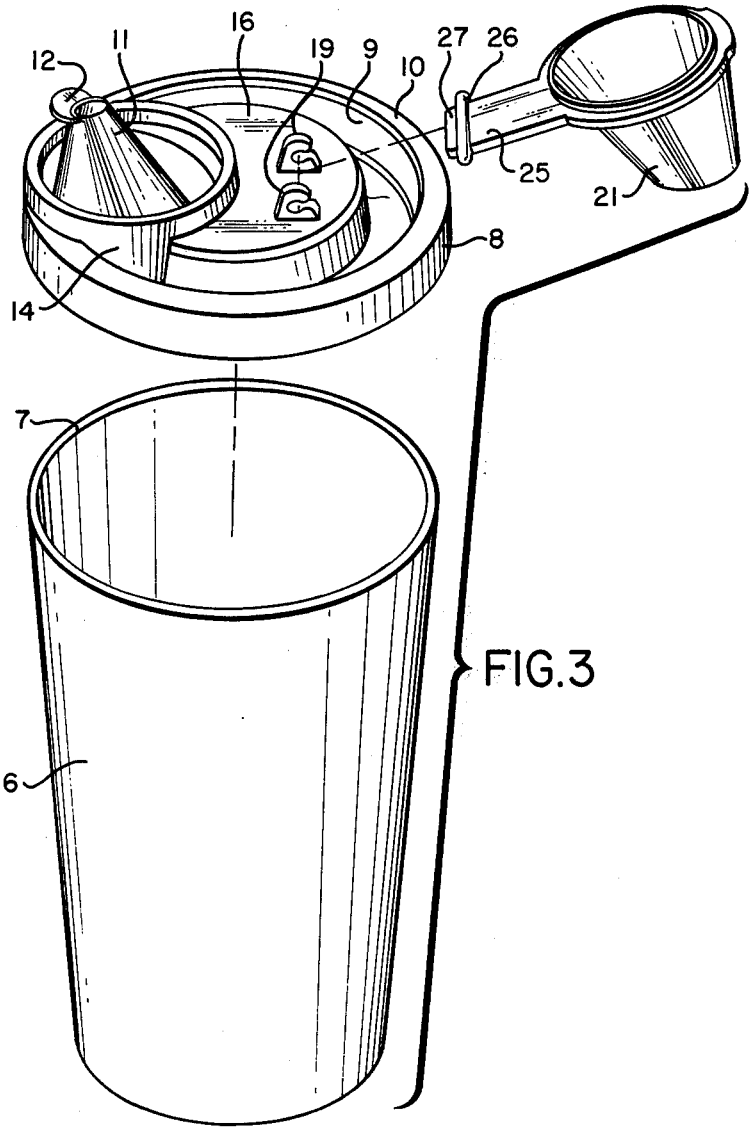
FIG. 3 is an exploded perspective view of the container of the present invention.
Figure 10:
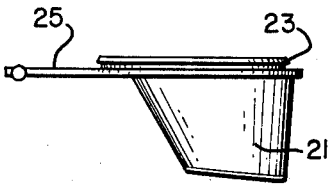
FIG. 10 is a side view of the cap of the present invention.
Figure 11:
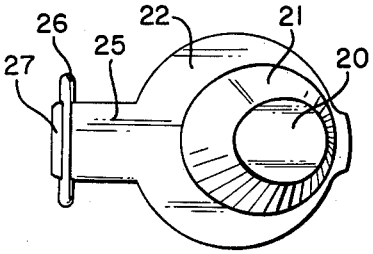
FIG. 11 is a top plan view of the cap of the present invention.
Figure 9:
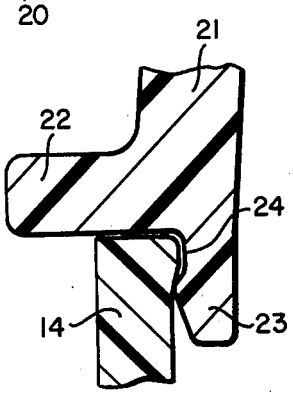
FIG. 9 is an enlarged cross-section taken from circled portion 9 of FIG. 4.
Figure 5:
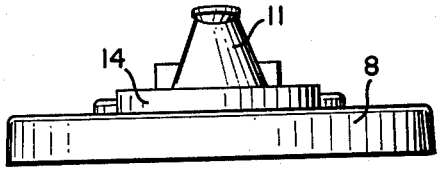
FIG. 5 is a front elevation view of the seal of the present invention.
Figure 6:
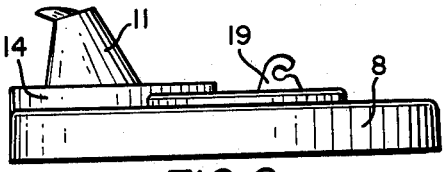
FIG. 6 is a side view of the seal of the present invention.
Figure 7:
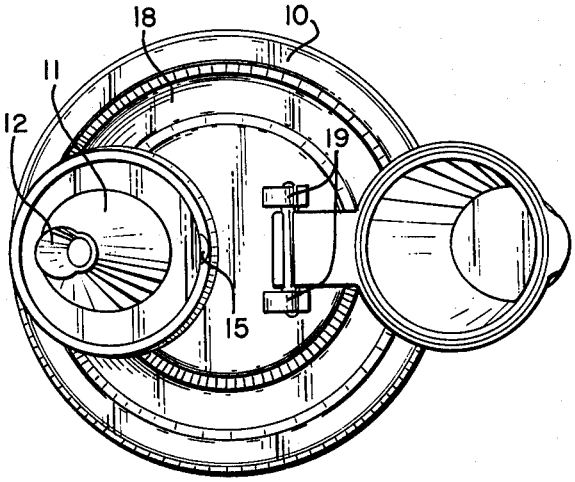
FIG. 7 is a top plan view of the seal of the present invention.
Figure 8:
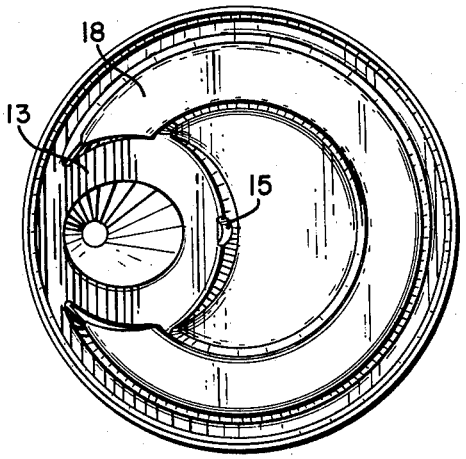
FIG. 8 is a bottom plan view of the seal of the present invention.

A pair of U-shaped lugs 19 are integral with the top side of wall 14. The lugs are formed so that the open side of the U faces away from the pouring spout 11. A cap having a top wall 20 and side walls 21 in a frustum shape is positionable over a pouring spout 11 to seal the pouring spout 11 and the opening 15 from the atmosphere. A flange 22 extends outwardly around most of the periphery of the cap and a locking ring 23 extends downwardly from the flange 22. The locking ring 23 has an undercut portion 24. (See FIG. 9). A strap 25 is affixed to the cap structure and has a trunion 26 which is snapped into the lugs 19. The trunion 26 pivots in the lugs so that the cap can be moved from an open position as shown in solid lines in FIG. 4 to a closed position as shown in dash lines in FIG. 4. The strap 25 extends beyond the trunion 26 as designated cam 27. When the cap is pivoted to the open position, approximately as shown in FIG. 2, the cam 27 engages the top wall 16 in a wedgelike fit and maintains the cap in open position during dispensing of liquids from the container. The inside face of wall 14 has a slight undercut peripheral portion near its upper end (see FIG. 9) so that when the cap is pivoted to the closed position, the locking ring 23 engages beneath the undercut portion on wall 14 in the manner shown in FIG. 9 to effectively seal the pouring spout in the area within wall 14 from the atmosphere.

The container of the present invention is preferably fabricated from plastic materials such as polyethylene or polypropylene. The material should have sufficient flexibility to permit the trunion 26 to be snapped into the lugs 19 but have sufficient rigidity so that the trunion is maintained within the lugs when the cam 27 engages the top wall 16. The purpose of having the lugs with the open side of the U away from the pouring spout is to insure that the trunion is not snapped out of the lugs when the cap is rotated to the open position and cam 27 engages wall 16.

While I have described a preferred embodiment in my invention it may be otherwise embodied within the scope of the following claims.

I claim:

1. A container for dispensing liquids comprising a container portion having a bottom wall and continuous upstanding peripheral walls terminating at an upper edge, a seal engaging said upper edge in a liquid-tight manner, a pouring spout extending upward from said seal, a cap movable to a position over the pouring spout to seal the pouring spout, said cap having an integral elongated strap with a trunion on the end thereof, a pair of spaced lugs integral with the seal and spaced from the pouring spout a sufficient distance to permit the trunion to pivot in the lugs in moving said cap to a sealing position over the pouring spout said strap and trunion including means that extend beyond said trunion, said means being engagable with the seal upon rotation of said cap to a position removed from its sealing position over said pouring spout thereby maintaining said cap in the non-sealing position.

* * * * *